United States Patent [19]

Bode et al.

[11] 4,366,457

[45] Dec. 28, 1982

[54] RADIATING COAXIAL CABLE HAVING APERTURES SPACED AT A DISTANCE CONSIDERABLY LARGER THAN A WAVELENGTH

[75] Inventors: Udo Bode, Langenhagen; Paul Thiele, Laatzen; Günter Möhring; Helmut Hildebrand, both of Langenhagen, all of Fed. Rep. of Germany

[73] Assignee: Kabel- u. Metallwerke Gutehoffnungshutte AG, Hanover, Fed. Rep. of Germany

[21] Appl. No.: 231,313

[22] Filed: Feb. 4, 1981

[30] Foreign Application Priority Data

Feb. 9, 1980 [DE] Fed. Rep. of Germany ..... 3004882

[51] Int. Cl.[3] ..... H01P 3/06

[52] U.S. Cl. ..... 333/237; 343/771

[58] Field of Search ..... 333/237, 240; 343/771

[56] References Cited

U.S. PATENT DOCUMENTS

| | | | |
|---|---|---|---|
| 2,455,224 | 11/1948 | Buchwalter et al. | 343/771 X |
| 3,321,762 | 5/1967 | Zucconi | 343/771 X |

FOREIGN PATENT DOCUMENTS

| | | |
|---|---|---|
| 1044199 | 11/1958 | Fed. Rep. of Germany . |
| 1690138 | 7/1973 | Fed. Rep. of Germany . |
| 2403646 | 8/1974 | Fed. Rep. of Germany . |
| 2811904 | 9/1979 | Fed. Rep. of Germany . |

*Primary Examiner*—Paul L. Gensler

*Attorney, Agent, or Firm*—Ralf H. Siegemund

[57] ABSTRACT

High-frequency radio waves are transmitted through a coaxial cable having apertures spaced at a distance considerably larger than the wavelength of the signals; the apertures are feed points for surface waves on the cable.

5 Claims, 4 Drawing Figures

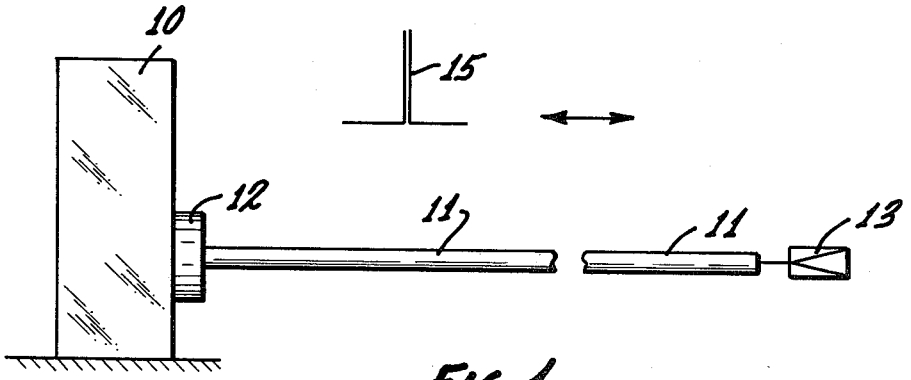
FIG. 1
FIG. 2
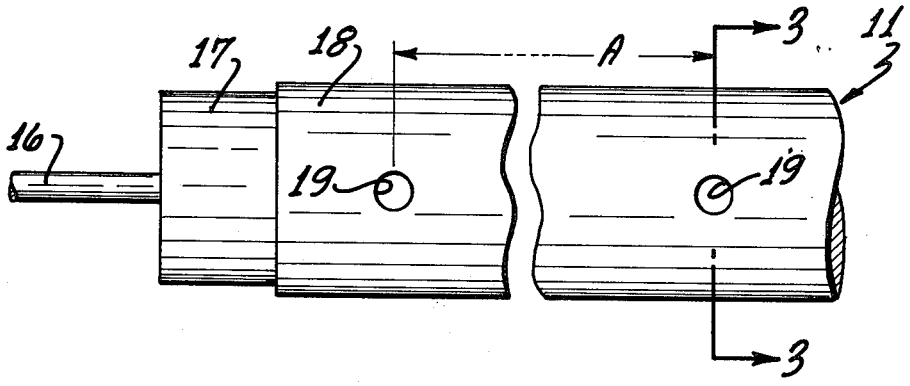
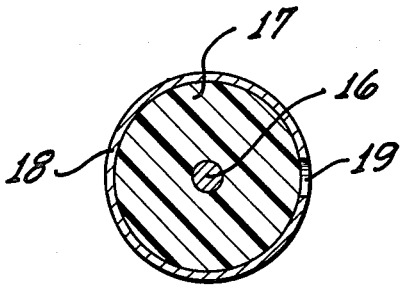
FIG. 3
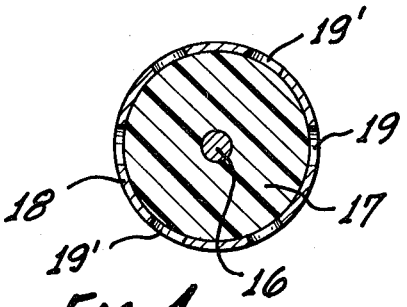
FIG. 4

RADIATING COAXIAL CABLE HAVING APERTURES SPACED AT A DISTANCE CONSIDERABLY LARGER THAN A WAVELENGTH

BACKGROUND OF THE INVENTION

The present invention relates to a radiating h-f transmission system, including a coaxial high-frequency cable.

A cable of the type to which the invention pertains is comprised of an inner conductor, an outer conductor, and a dielectric spacer which is interposed between the conductors. The outer conductor is provided with openings through which the cable radiates. These cables are used, for example, for transmitting h-f signals from a stationary source to a movable vehicle, or vice versa. A particular need exists, for example, for continuing communication with a vehicle as it passes through a tunnel. In the case of rail vehicles, these cables are laid along the rails, e.g., on the ties, or next to the ties and/or support posts, or at a tunnel wall.

German printed patent application No. 10 44 199 suggests a radiating cable in which the outer conductor has a continuous, axis-parallel slot so that the outer conductor does not fully envelope the inner conductor. The slot is rather wide, covering about 100° to 120°. This width is deemed to be too wide as it attenuates transmission through the cable, particularly when laid upon a moist ground. Aside from lossiness, the large opening invites ingress and penetration of moisture into the dielectric spacer material, attenuating the transmitted signal further.

German printed patent application No. 16 90 138 discloses such a cable, in which the radiating opening is restricted to spaced, obliquely oriented slots. The direction of extension and orientation of these slots varies, resulting in a zigzag pattern. The purpose of this arrangement is to suppress the axial component of the emanating electromagnetic field while the radial component is enhanced resulting in a more uniform signal strength at the mobile receiver. Unfortunately, the sum total of all of the openings is still a rather large area, offering basically the same disadvantages mentioned above concerning lossiness and/or moisture penetration.

German printed patent application No. 28 11 904 discloses a transmission system using a h-f cable having a physically closed outer conductor; in other words, the cable as such is a conventional, nonradiating one. Certain coaxial components are interspersed in the line, having radiating openings. This system is based upon the principle that radiation leaving such an opening is in parts transmitted as a surface wave on and along the outside of the closed, coaxial cable portion leading to the next radiating component. This system, however, poses the problem that the joints must have the same wave impedance as the h-f cable in order to avoid reflections. Also, the installation of this system requires highly skilled labor.

German printed patent application No. 24 03 646 discloses a radiating h-f cable in which openings are provided at a uniform, relatively short, spacing. The spacing of the openings is about equal to the outer diameter of the outer conductor and is, thus, considerably smaller than the wavelength of the signal to be transmitted. In view of the relatively large number of openings, the open area is still quite large; and again, one will encounter the disadvantages of water ingress, mentioned above.

DESCRIPTION OF THE INVENTION

It is an object of the present invention to provide a new and improved h-f radiating cable which does not suffer under moist and other disadvantageous environmental conditions to the extent that known cables do, so that, e.g., dielectric losses and signal attenuation are reduced.

It is another object of the present invention to provide a new and improved transmission system for h-f signals, using a transmitter and a radiating cable which is free from the deficiencies above.

In accordance with the preferred embodiment of the invention, it is suggested to provide a radiating cable, having inner and coaxial outer conductors and a dielectric spacer in between, and to provide discrete openings in the outer conductor having an axial spacing that exceeds the wavelength of the transmitted signal (carrier wave) and is independent therefrom. The aperture spacing is preferably considerably larger than the operating wavelength of the system, such as an order of magnitude. The invention is, thus, based upon the discovery that a radiating cable with apertures can be used as a transmission line for surface waves; and simple, spaced-apart apertures can be used as feed points for these surface waves; one does not need particular feed elements interrupting regular cable transmission.

The preferred embodiment of the invention, the objects and features of the invention, and further objects, features and advantages thereof, will be better understood from the following description taken in connection with the accompanying drawings.

DESCRIPTION OF THE DRAWINGS

FIG. 1 is a schematic view of a transmission line improved in accordance with the present invention;

FIG. 2 is a broken-away side elevation of a cable constructed in accordance with the preferred embodiment of the invention for practicing the best mode thereof;

FIG. 3 is a section view taken along line 3—3 in FIG. 2; and

FIG. 4 is a similar section view, but of a modified cable.

Proceeding now to the detailed description of the drawings, FIG. 1 illustrates a transmitter 10, transmitting h-f energy into a radiating, coaxial cable 11. That cable is connected to the transmitter by means of a suitable coupler 12. Reference numeral 13 refers to a terminating element at the end of the cable, being constructed and dimentioned for avoiding reflections.

The cable is laid, e.g., along a railroad track; its purpose is to provide control and/or other communication signals to a vehicle running on that track. The receiving antenna of that vehicle (dipole) is schmatically indicated as 15. Functionally, that antenna moves along the cable at a constant distance therefrom.

As shown in FIGS. 2 and 3, the h-f cable 11 includes an inner conductor 16, an outer conductor 18, and a dielectric spacer 17 in between. The inner conductor 16 is a wire or a tube and is, preferably, made of copper. The insulation-dielectric material 17 is a solid or foamed plastic material, such as polyethylene.

Alternatively, one may provide individual spacer disks on the inner conductor for supporting the outer one. Still alternatively, a spacer helix may be wrapped around that inner conductor.

The outer conductor is a tube 18 which has round openings 19. These openings are few and far apart; their distance A is larger, preferably considerably larger than the operating wavelength for the carrier frequency. Assuming that this carrier frequency is 100 MHz and assuming further that the insulating and dielectric spacer is made of solid polyethylene, then the wavelength in question is 2 meters. In the case of a carrier frequency of 450 MHz, the wavelength is 0.44 meter. In both cases, a spacing A of 10 meters suffices. Thus, the distance is about one order of magnitude higher.

The apertures 19 of the cable are feed points through which electromagnetic energy is emitted for propagating along the outer conductor as surface waves. These surface waves can be picked up in the vicinity of the entire cable. The apertures 19 are, thus, essentially points for replenishing these surface waves. The spacing A, however, should not exceed 50 meters. This upper limit of an approximately 50-meter spacing is given by the condition that the surface wave will, of course, be attenuated, while adequate signal strength for pickup must be assured throughout.

The sum total of all apertures is quite small, particularly so when compared with the entire surface of the cable. Thus, there is hardly any effect on the cable from the environment. Very little moisture can penetrate into the cable so that the propagation and transmission characteristics of the cable are not interfered with.

For reasons of ease of manufacture, the spacing of the apertures should be constant. However, certain variations may be deemed advisable in certain cases. For example, reflection peaks can be avoided by variations in spacing. These peaks can arise for certain wavelengths if the aperture spacing does not vary because components of equal phase may be added to each other, particularly near the beginning of the cable. As a general rule, these apertures should be spaced independently from the carrier's wavelength; but a subharmonic relation with the carrier and, particularly, with the information modulation may not always be avoidable. It is for this reason that one should introduce a certain irregularity into the aperture's spacing so that a subharmonic relation can (if at all) exist only, e.g., in one stretch as between two successive apertures. The next and preceding spacings will not match that relation with certainty. Of course, the general rule must still be observed that the spacing remains well above the operating wavelength.

It may be advisable to use more than one aperture 19 in each location, where an aperture is to be placed. For example, FIG. 4 shows that several such apertures 19, 19', etc. are distributed around the periphery so that the cable radiates in all directions, or at least not more or less exclusively into one direction. This way, installation and positioning of the cable becomes less critical vis-a-vis the mobile receiver passing along.

The apertures 19 are shown to be circular; this is convenient and preferred for a variety of reasons, but not essential in principle. One may use other shapes, even slots.

The outer conductor is preferably made from a strip, e.g., of copper or aluminum. The apertures are punched into that strip, e.g., as it is paid from a spool or the like. This strip is then formed longitudinally into a tube and around the concurrently paid inner conductor carrying, for example, insulating disks or a helix. In the case of foaming, that foam may develop in situ after the strip has been closed into a tube. Alternatively, the insulation may be formed as a solid tube or as a free foaming tube prior to providing the outer conductor around the subassembly.

The edges of this strip are seam-welded; and preferably, the resulting tube is subsequently drawn to the desired coaxial dimensions and sits tightly on the insulation.

The invention is not limited to the embodiments described above; but all changes and modifications thereof, not constituting departures from the spirit and scope of the invention, are intended to be included.

We claim:

1. A transmission system which includes a source of h-f signals and a coaxial cable, the h-f signals having a particular carrier frequency, the cable being comprised of an inner conductor, an outer conductor coaxial to the inner conductor, and a dielectric spacer means in between, the carrier frequency signals as propagating through the cable having a particular wavelength, the improvement comprising:

a plurality of apertures in the outer conductor being spaced in axial direction at distances, each being considerably larger than the particular wavelength, for establishing spaced apart feed points for surface waves traveling along said outer conductor.

2. A transmission system as in claim 1, the spacing being not smaller than 10 meters and not larger than 50 meters.

3. A radiating coaxial cable, having inner and coaxial outer conductors and a dielectric spacer means in between, for use as a radiating transmitter at a particular frequency, the particular frequency having a particular wavelength in the cable, the improvement of a plurality of axially spaced apertures, there being a plurality of interspersed spacing accordingly, each spacing having a spacing length well in excess of said wavelength, so that each aperture constitutes a feed point for surface waves.

4. A transmission system or cable as in claim 1 or 3, there being additional apertures, spaced peripherally and still having said axial spacing.

5. A method of transmitting h-f signals along and from a particular, lengthy path, comprising the steps of using a coaxial h-f cable having an outer conductor with a plurality of apertures being spaced respectively by interspersed spacings, each spacing being considerably larger than the wavelength of the carrier of the h-f signals; and feeding h-f energy to the cable, h-f energy leaving the apertures and traveling as surface waves along the outer conductor, the feeding including replenishing surface wave energy through these spaced-apart apertures.

* * * * *